US005539415A

United States Patent [19]

Metzen et al.

[11] Patent Number: 5,539,415

[45] Date of Patent: Jul. 23, 1996

[54] ANTENNA FEED AND BEAMFORMING NETWORK

[75] Inventors: Phillip L. Metzen, Foster City; Richmond D. Bruno, San Jose; Richard W. LeMassena, Los Gatos, all of Calif.

[73] Assignee: Space Systems/Loral, Inc., Palo Alto, Calif.

[21] Appl. No.: 306,820

[22] Filed: Sep. 15, 1994

[51] Int. Cl.[6] ..... H01Q 1/38

[52] U.S. Cl. ..... 343/700 MS; 343/850; 343/853

[58] Field of Search ..... 343/700 MS, 850, 343/853, 858, 864; 342/368; H01Q 1/38

[56] References Cited

U.S. PATENT DOCUMENTS

| | | | |
|---|---|---|---|
| 4,168,503 | 9/1979 | Davidson | 343/754 |
| 4,208,660 | 6/1980 | McOwen, Jr. | 343/789 |
| 4,503,436 | 3/1985 | Cramer, Jr. | 343/876 |
| 4,761,653 | 8/1988 | Owens et al. | 343/700 MS |
| 4,903,033 | 2/1990 | Tsao et al. | 343/700 |
| 4,931,802 | 6/1990 | Assal et al. | 342/373 |
| 4,947,176 | 8/1990 | Inatsune et al. | 342/173 |
| 5,019,829 | 5/1991 | Heckman et al. | 343/700 MS |
| 5,081,464 | 1/1992 | Renshaw | 342/375 |
| 5,166,690 | 11/1992 | Carlson et al. | 342/157 |
| 5,233,358 | 8/1993 | Murphy | 342/375 |
| 5,276,455 | 1/1994 | Fitzsimmons et al. | 343/777 |
| 5,283,587 | 2/1994 | Hirshfield et al. | 342/372 |
| 5,327,152 | 7/1994 | Kruger et al. | 343/853 |

FOREIGN PATENT DOCUMENTS

| | | |
|---|---|---|
| B17137 | 12/1992 | Australia . |
| 1226934 | 9/1987 | Canada . |
| 0253465 | 1/1988 | European Pat. Off. . |
| 0311919 | 4/1989 | European Pat. Off. . |
| 0405372 | 1/1991 | European Pat. Off. . |
| 0407243A1 | 1/1991 | European Pat. Off. . |
| 0448318A3 | 3/1991 | European Pat. Off. . |
| 0600715A2 | 6/1994 | European Pat. Off. . |
| 0624008A3 | 11/1994 | European Pat. Off. . |
| 0516039 | 12/1992 | France . |
| WO88/01106 | 2/1988 | WIPO . |
| WO88/08623 | 11/1988 | WIPO . |
| WO91/08621 | 6/1991 | WIPO . |

OTHER PUBLICATIONS

Patent Abstracts of Japan, vol. 13, No. 378, Aug. 22, 1989, JP-A-01 129 509 (Toshiba).

Patent Abstracts of Japan, vol. 9, No. 154 (E-325) 28 Jun. 1985 & JP-A-60 033 745 (Nippon Denshin Denwa Kosha) 21 Feb. 1985.

*Primary Examiner*—Hoanganh Le

*Attorney, Agent, or Firm*—Perman & Green

[57] ABSTRACT

This invention is a small, inexpensive lightweight, easy to assemble multibeam or phased array device which may be used as a feed for a reflector or lens antenna. The device employs an array of planar radiators coupled to stripline hybrids to form individual feed or antenna elements. The feed or antenna elements are then coupled into a filter in order to pass the desired band or frequencies and reject undesirable bands or frequencies.

8 Claims, 8 Drawing Sheets

ANTENNA FEED AND BEAMFORMING NETWORK

FIELD OF THE INVENTION

The invention relates generally to the field of electronic circuits, and particularly to antennas and beamforming networks.

BACKGROUND OF THE INVENTION

Communications is the transmission of intelligence between two or more points. The science and technology of communication deals with the manner in which information is collected from an originating source, transformed into electric currents or fields, transmitted over electrical networks or space to another point, and reconverted into a form suitable for interpretation by a receiver.

Typically, communications systems consists of cascaded networks, each network designed to carry out some operation on the energy conveying the information. Antennas are often the networks serving to transfer the signal energy from circuits to space and, conversely, from space to circuits. The signal energy is in the form of beams i.e. a plurality of straight lines in which each straight line represents a beam. The beams are a collimated or approximately unidirectional flow of electromagnetic radiation. The distribution of the radiated energy varies with the direction in space and with the distance from the antenna. This gives rise to the directive properties of the antenna.

Satellite communications antennas have been developed to provide precisely tailored beams to cover multiple designated coverage areas on the earth without wasting antenna radiated power on regions where there are no users of interest. The prior art utilized multibeam antennas or phased arrays to provide precisely tailored beams.

Space bound antennas were individually designed and assembled for a particular satellite. Each satellite was usually launched for a specific purpose. Each element of the many elements of the antenna had to be individually fabricated and assembled. Thus, the antenna was very expensive to fabricate and assemble. The satellite antenna industry has not heretofore provided an antenna that did not use completely different antenna components, notwithstanding that packaging engenders efficiency in manufacturing, and also importantly provides the necessary flexibility to design antennas that meet different satellite needs.

One of the disadvantages of the prior art was that multibeam antennas and phased arrays were large and heavy.

An additional disadvantage of the prior art was that multibeam antennas and phase arrays were difficult and expensive to implement on a recurring basis.

SUMMARY OF THE INVENTION

The present invention overcomes the disadvantages of the prior art by providing an inexpensive, small, compact, light weight, easily to assemble, multibeam or phased array device which may be used as a direct radiating array or as a feed for a reflector or lens antenna. The device employs an array of planar radiators coupled to stripline hybrids to form individual feed or antenna elements. The feed or antenna elements are then coupled into a filter in order to pass the desired band of frequencies and reject undesirable bands of frequencies. The filters are coupled either to the MMIC LNA's for the receive version or to the MMIC SSPA's for the transmit version.

The MMIC's are combined into a stripline beamforming network (BFN) that produces M beams, each using all N of the antenna radiating elements. The shape of each of the M beams is determined by the phase and amplitude characteristics of its portion of the beamforming network. Each of the M beams has a separate input (transmit) or output (receive) port. The aforementioned functions may be integrated into a single package comprising microwave circuits etched on multilayer copper plated circuit boards together with MMIC amplifiers and integrated filters.

DESCRIPTION OF THE PREFERRED EMBODIMENTS

Figure 1:
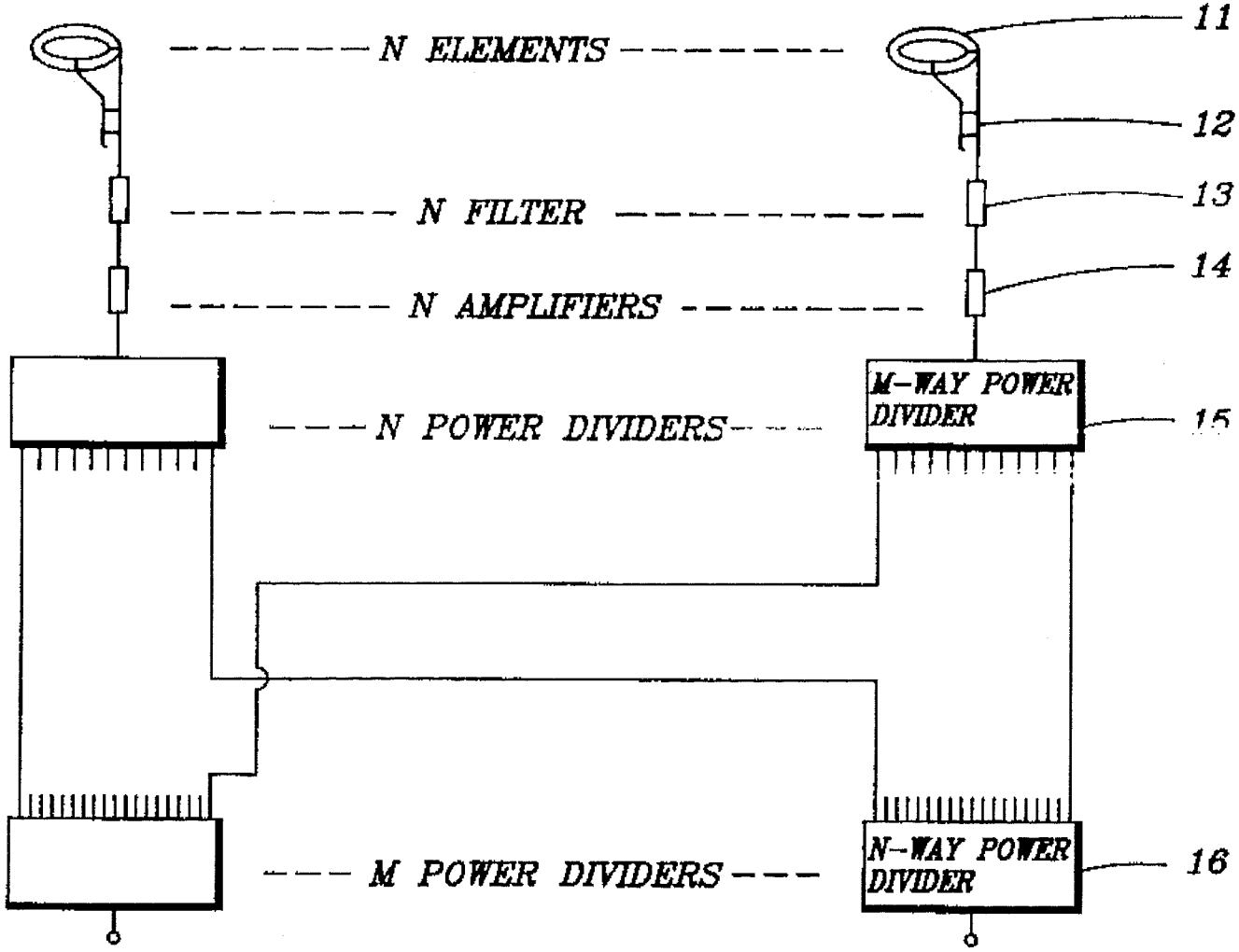
FIG. 1 is a block diagram of the apparatus of this invention.

Referring now to the drawings in detail, and more particularly to FIG. 1, the reference character 11 represents a plurality of TE11 mode annular slot planar radiators, that contain N radiators 11. Radiators 11 are coupled to a plurality of stripline hybrids or quadrature stripline couplers 12, to form circularly polarized radiation. However, linearly polarized beams can be formed by omitting the quadrature stripline couplers 12. Hybrids 12 are coupled to a plurality of band pass filters 13, that contain N band pass filters 13, in order to pass only the desired bands of frequencies. Filters 13 are coupled to Monolithic Microwave Integrated Circuit (MMIC) amplifiers 14 that contain N amplifiers 14 with an integral isolator. Amplifiers 14 are Solid State Power Amplifiers (SSPA's) or Low Noise Amplifiers (LNA's). SSPA's are used for the transmit mode and LNA's are used for the receive mode. Amplifiers 14 are utilized to amplify the aforementioned RF signals.

Amplifiers 14 are coupled to a plurality of M-way power dividers 15, that contain N power dividers 15, and M-way power dividers 15 are coupled to a plurality of N-way power dividers 16, that contain M dividers 16.

For the case of sixteen beams generated by the apparatus illustrated in FIG. 1, N equals 91, and M equals 16. There are 16 separate N-way Power dividers 16, 91 separate MMIC's 14, 91 separate filters 13, 91 separate quadrature couplers 12 and 91 separate radiating elements 11. The outputs of N-way power dividers 16 are recombined in M-way power dividers 15. There are 91 M-way power dividers 15. The output of each M-way power divider 15 is coupled through an amplifier 14, a filter 13 and quadrature coupler 12 to a radiating element 11. The shape of each of the 16 antenna beams is specifically set by the N-way power divider 16 associated with that beam, by adjusting the amplitude and phase elements. The phase and amplitude response of each of the MMIC's 14 are equal, as is the phase and amplitude of the filters 13, quadrature couplers 12 and the radiating elements 11.

Figure 2:
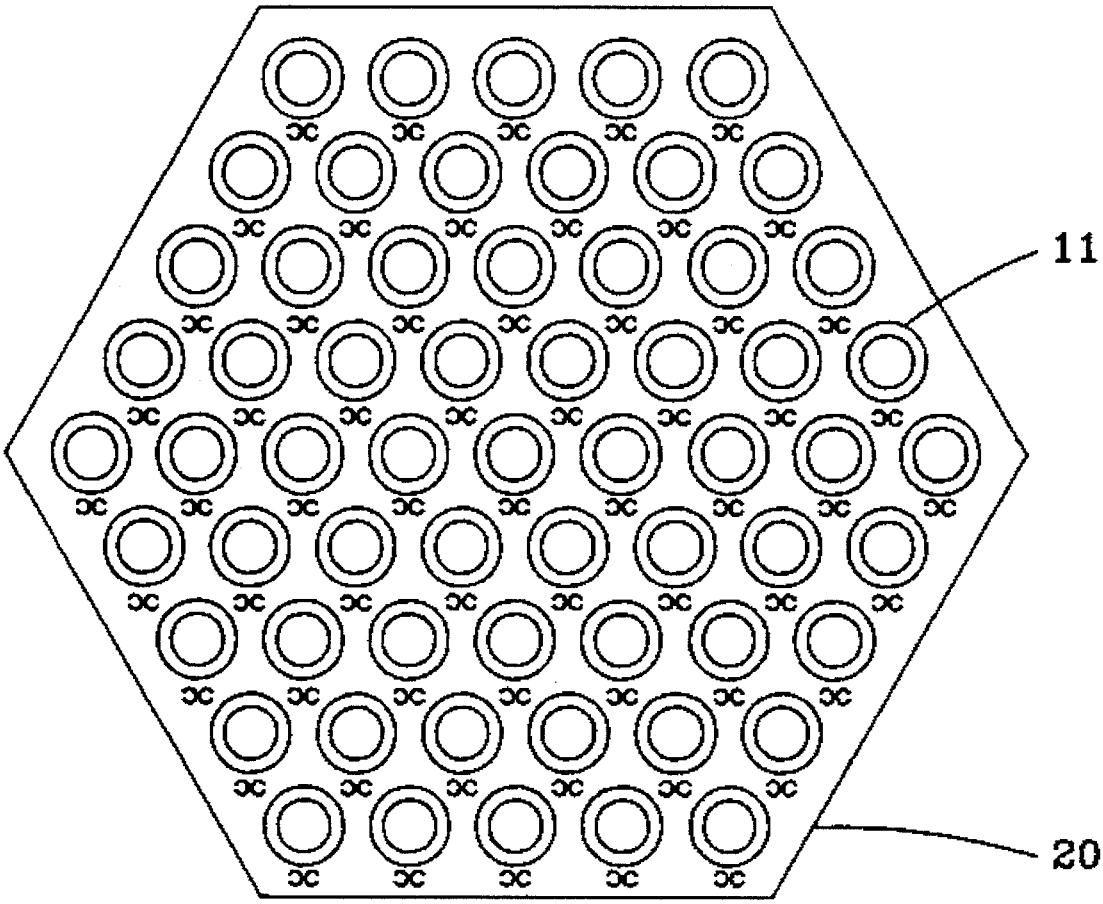
FIG. 2 is a drawing of a top view of radiating elements 11 of FIG. 1.

FIG. 2 is a drawing of a top view of radiating elements 11, which was described in the description of FIG. 1. Radiating elements 11 are arranged in array board 20 in a manner that the receive version of the apparatus of this invention has 61 radiating elements 11 and the transmit version of this invention has 91 radiating elements 11.

Figure 3:
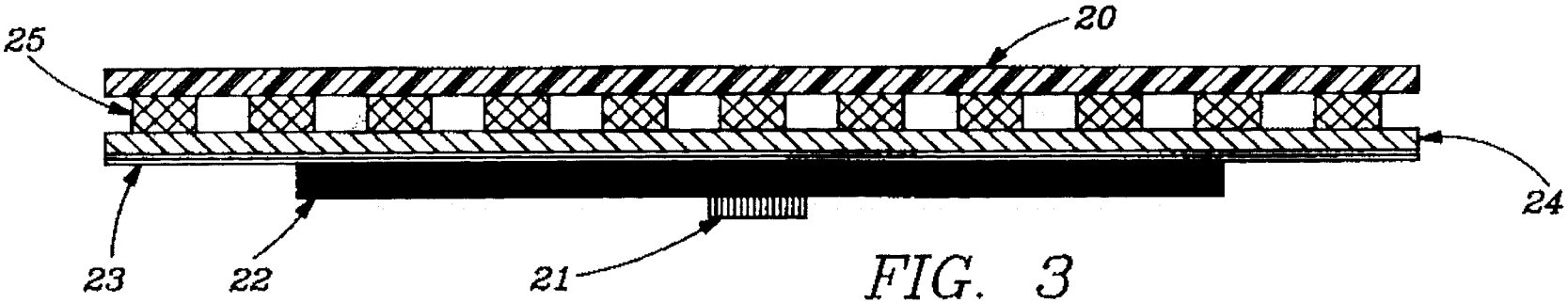
FIG. 3 is a drawing of a side view of the antenna assembly.

FIG. 3 is a side view of the antenna assembly. The sixteen coaxial cables 21 provide interface to the input to the antenna in the transmit case and in the receive case, cables 21 interface the output of the antenna. Thirty two bonded stacked PC boards comprising all of the M-way and N-way combiners in an integrated beamforming network (BFN) are represented by character 22. The Beamforming network 22 interface is contained in PC boards 23 (BFN interface). Interconnections between the BFN interface 23 and N electronic modules 25 passes through heat sink 24.

Heat sink 24 may be constructed of beryllium or any other known material that will remove sufficient amounts of heat when the antenna is operational.

Array boards 20, which include radiating elements 11 and quadrature couplers 12, are mounted atop electronic modules 25. Heat sink 24 is mounted below modules 25. BFN interface 23 is mounted below heat sink 24 and beam forming network 22 is mounted below BFN interface 23. The inputs to antenna 21 are mounted to network 22. Each electronic module 25 includes a filter 13 and MMIC 14. Each MMIC contains an integrated output isolator to assure spurious-free operation in the presence of the bandpass filter 13.

Figure 4:
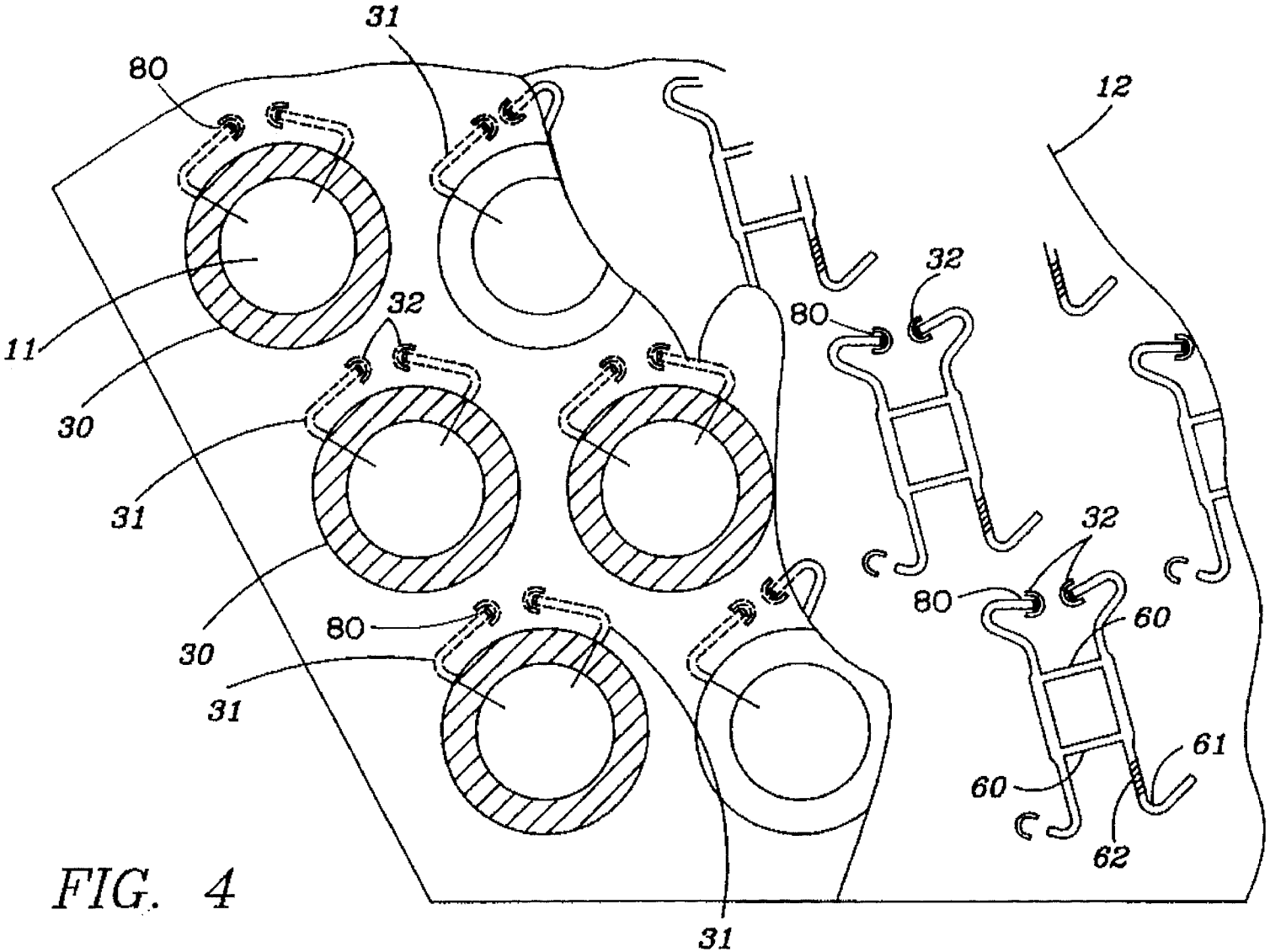
FIG. 4 is a drawing of the PC boards that contain radiating elements 11 and quadrature couplers 12.

FIG. 4 is a drawing of the PC boards that contain radiating elements 11 and quadrate couplers 12. Concentric rings 30 are dielectrics i.e., the portions of radiating element 11 in which copper has been etched away from the PC board. One layer or one board down from radiating elements 11 are radiating element probes 31 and the input lines 32 to probes 31. One layer or one board down from probes 31 and input lines 32 are a plurality of quadrature couplers 12 and the input lines 33 to couplers 12. The input lines 32 to probes 31 and the input lines 33 to quadrature couplers 12 line up with each other. Thus, lines 31 and 33 are connected to each other through plated holes (80). Input lines 32 are connected to branch line couplers 60. Coupler 60 is connected to a quarter-wave length ($\lambda/4$) open ended stub 61 and a 50 ohm etched film resistor 62 is etched on stub 61.

Figure 5:
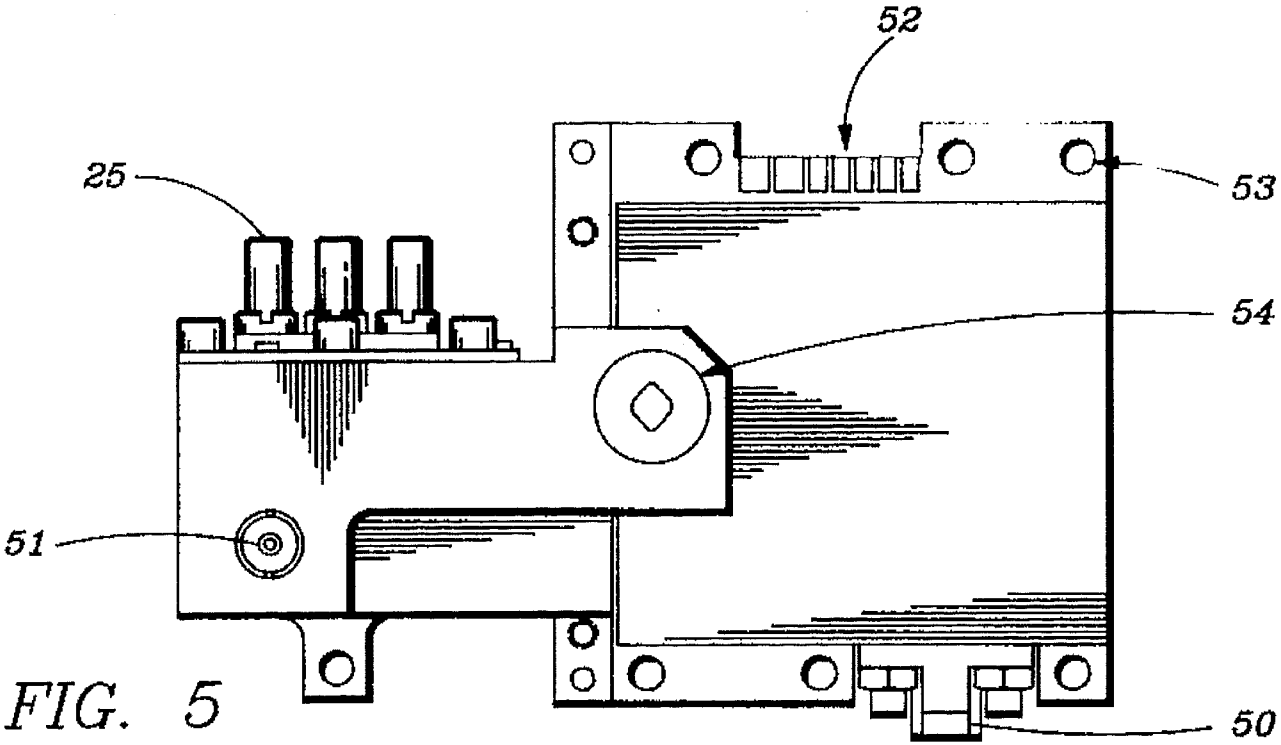
FIG. 5 is a drawing of an electronics module 25.

FIG. 5 is a drawing of an electronics module 25. Contained within this module is one MMIC amplifier/isolator 14 and one filter 13 (not shown). Input and output RF coaxial interfaces 50 and 51 are sub-miniature push-on connectors, and the power interface employs a ceramic feed-through push-on connector 52. An integral mounting flange 53 allows module 25 to be securely fastened to heat sink 24 (not shown). Flange 54 provides a mounting surface for array board 20 (not shown).

Figure 6:
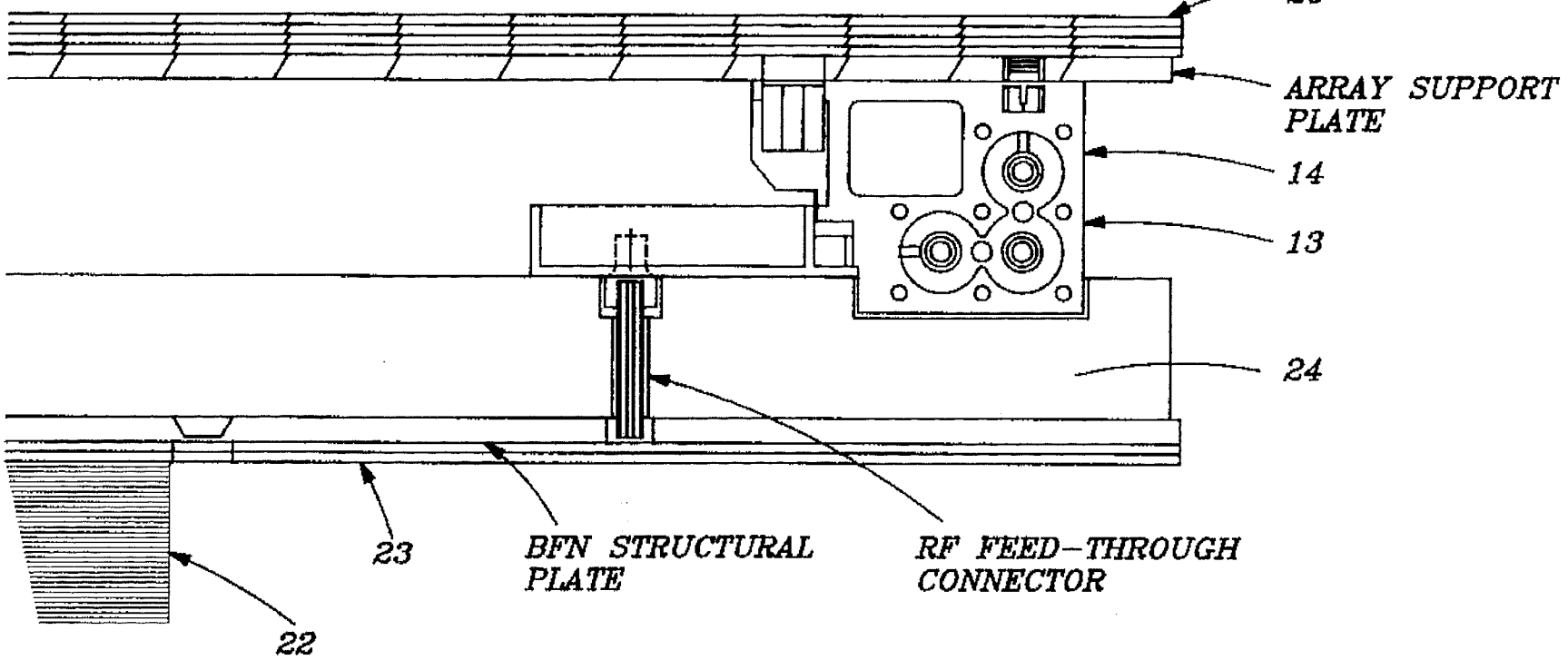
FIG. 6 is a drawing of an integrated electronics module 25 and array boards 20.

FIG. 6 is a drawing of an integrated electronics module 25 and array boards 20. Also shown are the relative locations of the heat sink 24, BFN interface boards 23 and beam forming network (BFN) 22. All RF interface cables 21 are by SMA type coaxial connectors. Cables 21 are attached to beam forming network 22.

Figure 7:
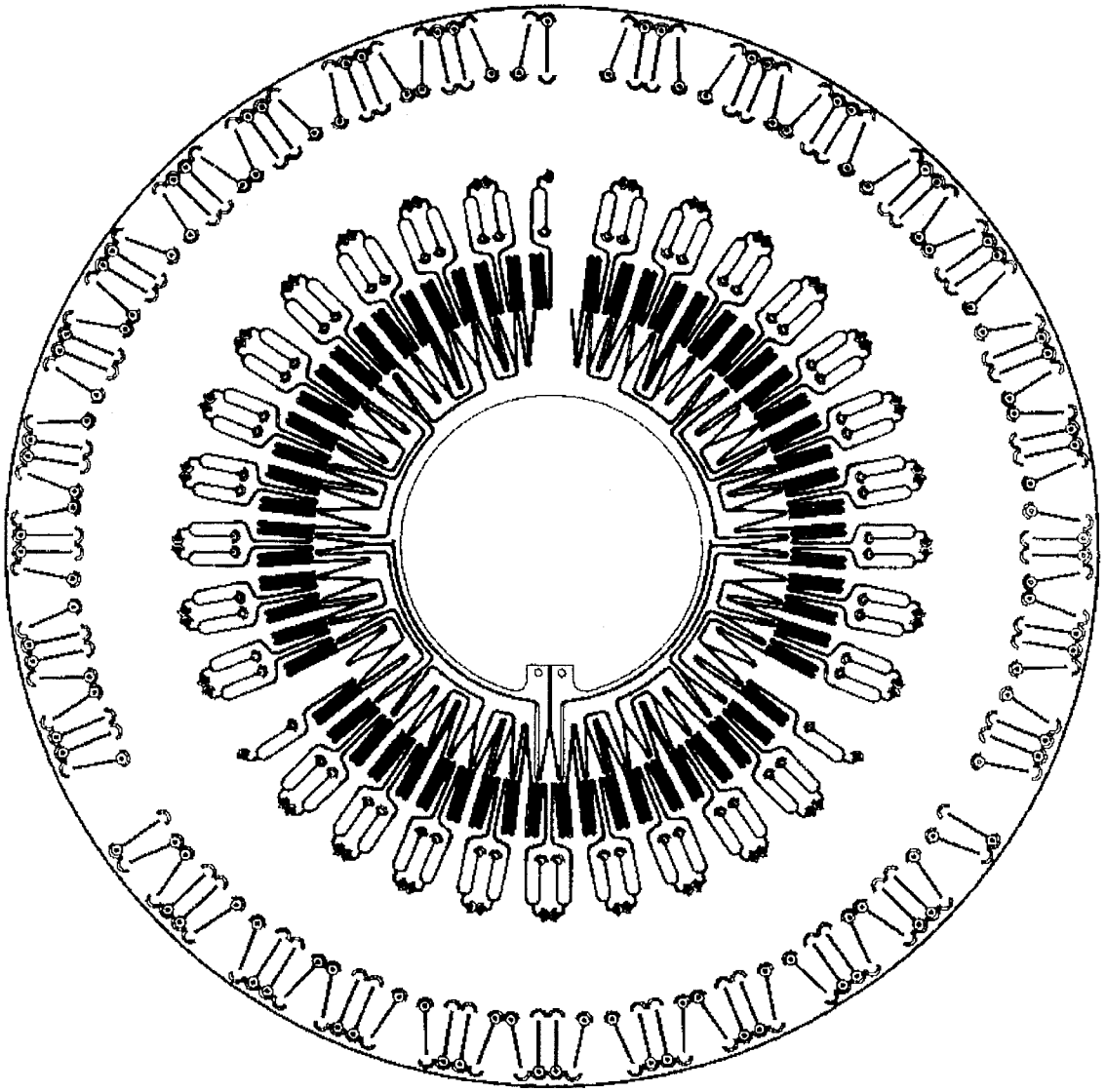
FIG. 7 is a drawing of one layer of a 16 layer beam forming network 22.

FIG. 7 is a drawing of one layer of a 16 layer stripline beam forming network 22. The central region of the circuit board shown comprises a 91-way equal split power divider using simple Wilkinson hybrid "v shaped" power splitters.

Figure 8:
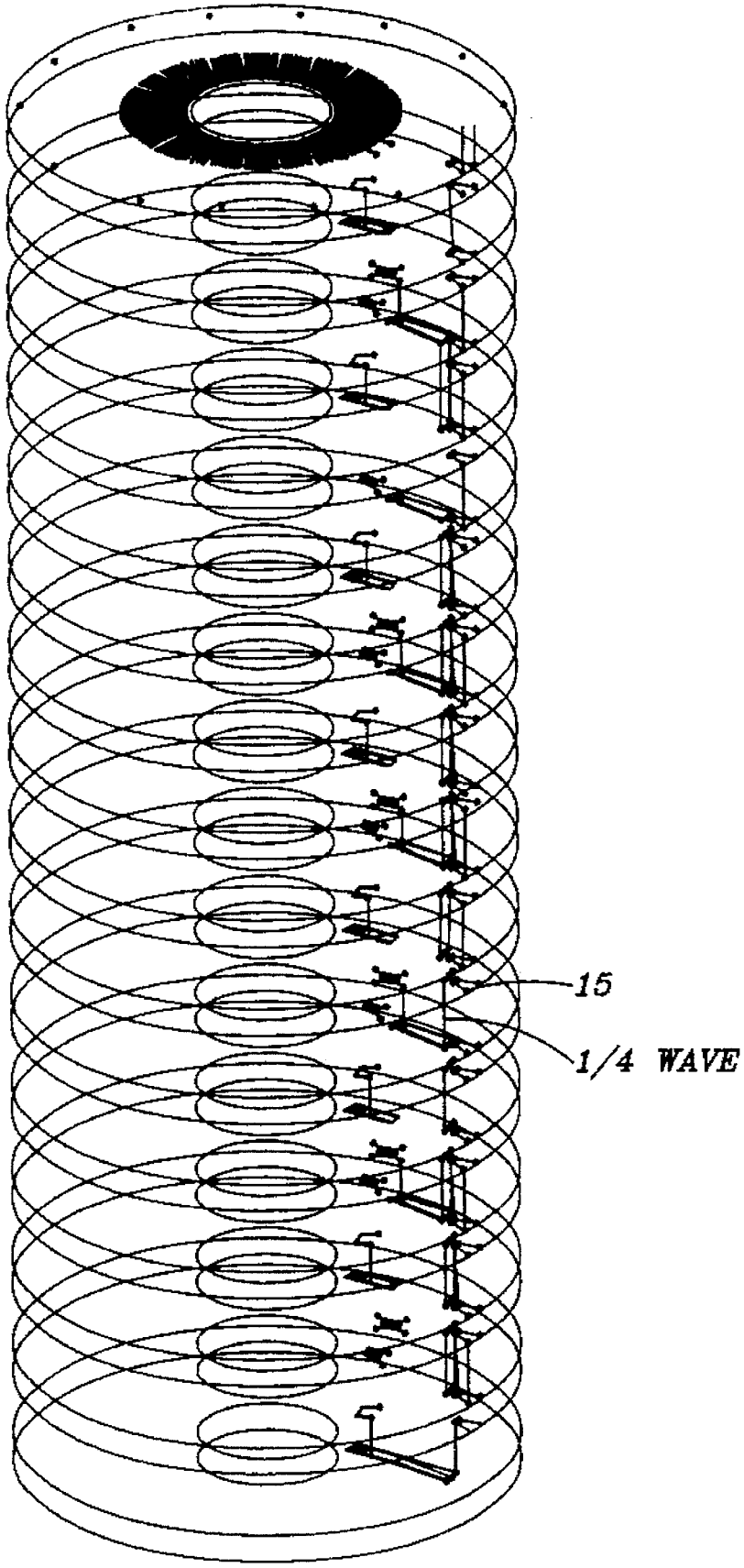
FIG. 8 is a drawing of the stack of 32 PC boards.
Figure 9:
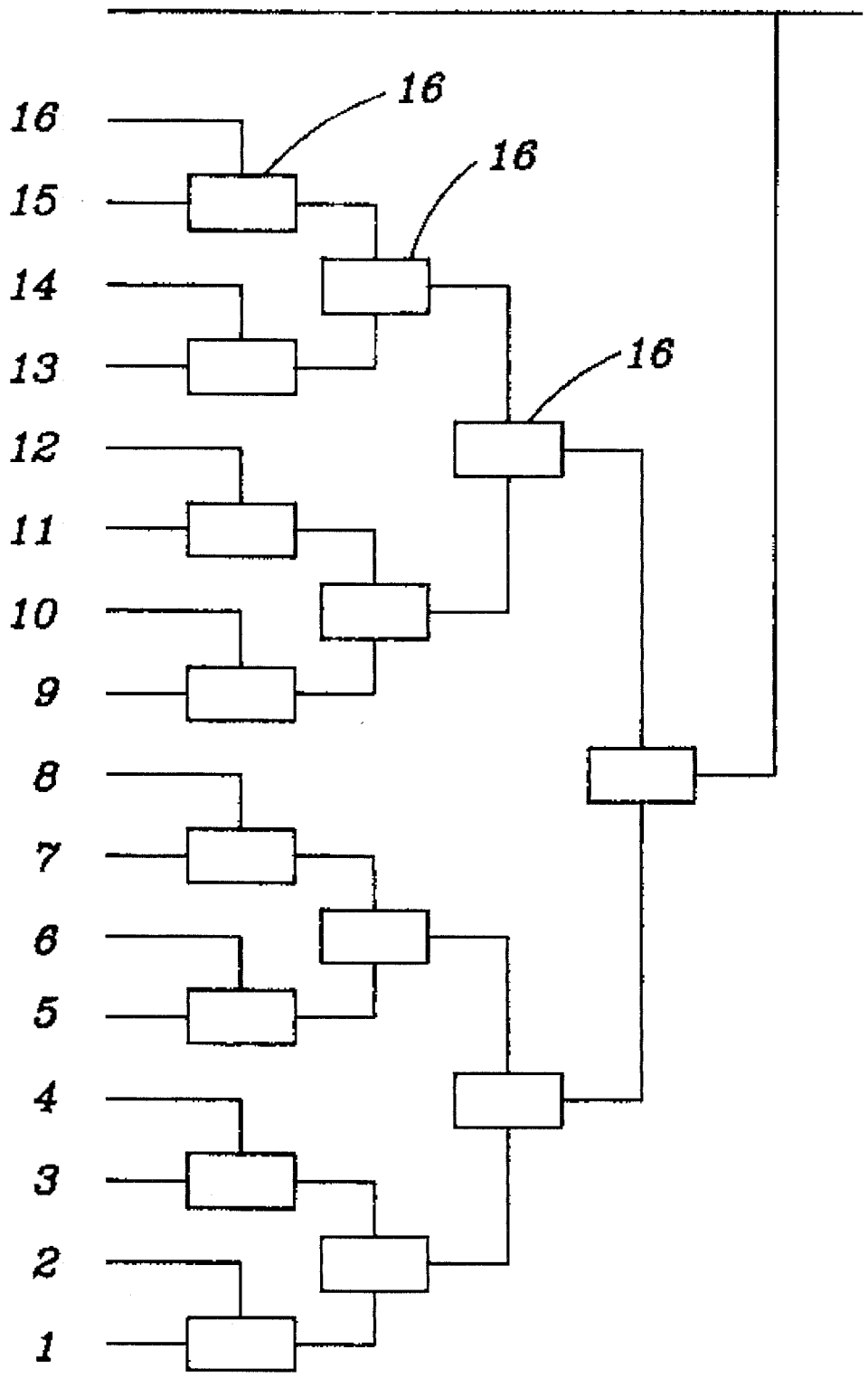
FIG. 9 is a schematic depiction of the four level binary power combination scheme employed within the 32 bonded stack comprising the bonded stripline beamformer 24.

Each output of the 91 dividers is connected to a phase trimmer in the form of a series of transmission line meander. The meander length at each output of the 91-way divider determines the beam shape and spatial position of a given antenna beam. By virtue of the foregoing feature each of the 16 beamformers can provide discrete beam shapes and aiming directions. Phase trimmer outputs are connected to a multiplicity of Wilkinson power combiners ("u" shaped, and dividers within isolation resistors) which serve to combine beamforming network 22. Outputs from multiple layers of the beamforming network are shown in the descriptions of FIGS. 8 and 9. The RF coaxial interface outputs 51 comprise M-way power dividers 15 (not shown) which are contained in the vertical plane of the bonded stripline beamformer assembly.

FIG. 8 is a drawing of the stack of 32 PC boards. The M-way power dividers 15 are positioned along the periphery of each of the 32 PC boards in the stack. The PC boards are interconnected by ¼ wave overlapping separated by bonding film lines. In the beamforming network 22, the isolation resistors of the Wilkinson power dividers can be coupled by quarter-wavelength overlaps to facilitate resistor testing.

FIG. 9 is a schematic depiction of the four level binary power combination scheme employed within the 32 bonded stack comprising the bonded stripline beamformer 24.

In the beamforming network portion of the apparatus of this invention sixteen beams are produced by 32 PC boards, that have 16 input cables, wherein each input cable represents a beam in space. All of the interconnections take place between the PC boards. The use of a ¼0 wave overlapping line allows the apparatus of this invention to only have to pass through two boards. At no time does an interconnection have to pass through more than two boards at a time. The number of boards are placed back to back. The holes are plated and the boards are interconnected.

The above specification describes new and improved inexpensive, small, compact, light weight, easily assembled, multibeam or phased array device easily reproduced to a high degree of accuracy which may be used as a direct radiating array or as a feed for a reflector or lens antenna. It is realized that the above description may indicate to those skilled in the art additional ways in which the principals of this invention may be used without departing from the spirit. It is, therefore, intended that this invention be limited only by the scope of the appended claims.

What is claimed is:

1. A multibeam phased array which is integrated into a compact package that comprises:

a bonded stripline array package that includes a plurality of planar radiating elements that are etched on said array package and are capable of providing either linear or circular polarization;

a supplemental array of amplifier modules for respective ones of said radiating elements wherein each of said modules contains a MMIC isolator and a bandpass filter;

a multilevel bonded stripline beam-forming network providing multiple beam outputs; and an interface interconnected between said supplemental array of amplifier modules and said beamforming network;

wherein said beamforming network comprises a plurality of adjacent circuit boards that have M input ports and N output ports, wherein M and N are integers, in which interconnections take place between said adjacent circuit boards by plated through holes, wherein adjacent pairs of said circuit boards are stacked and bonded, and wherein electrical coupling between adjacent pairs of said circuit boards is by quarter-wavelength overlaps separated by bonding film.

2. The phased array claimed in claim 1, further including a heat-sink coupled to said array of amplifier modules for removing heat.

3. A multibeam phased array which is integrated into a compact package that comprises:

a bonded stripline array package that includes a plurality of planar radiating elements that are etched on said array package and are capable of providing either linear or circular polarization;

a supplemental array of amplifier modules for respective ones of said radiating elements wherein each of said modules contains a MMIC isolator and a bandpass filter;

a multilevel bonded stripline beam-forming network providing multiple beam outputs;

an interface interconnected between said supplemental array of amplifier modules and said beamforming network; and wherein said beamforming network comprises a plurality of wilkinson power dividers within isolation resistors which can be coupled by quarter-wavelength overlaps to facilitate resistor testing.

4. An M-beam phased array antenna assembly, comprising:

a first multilevel stripline package comprising N annular planar radiating elements, all of which are formed on a surface of said stripline package, and N RF couplers, said N radiating elements providing one of linear and circular polarization;

N amplifiers having outputs coupled to said N RF couplers;

a second multilevel stripline package comprising N, M-way power dividers each of which has an output coupled to one of said N amplifiers and M inputs, wherein M and N are integers, individual ones of said M inputs being coupled to an output of M, N-way power dividers having N outputs and one input, wherein said second multilevel stripline package is comprised of a plurality of stacked circuit boards in which individual ones of pairs of circuit boards are disposed back-to-back and are electrically coupled together by feedthroughs, and wherein adjacent circuit boards of adjacent pairs of circuit boards are electrically coupled together by tuned RF coupling means.

5. An M-beam phased array antenna assembly as set forth in claim 4, wherein at least a stripline length of said M, N-way power dividers determines a shape and spatial location of said M beams.

6. An M-beam phased array antenna assembly as set forth in claim 4, wherein M is equal to 16 and N is equal to 91.

7. An. M-beam phased array antenna assembly as set forth in claim 4, wherein said M-beam phased array antenna assembly is carried aboard a communications satellite.

8. An M-beam phased array antenna assembly, comprising:

a first multilevel stripline package comprising N annular planar radiating elements, all of which are formed on a surface of said stripline package, and N RF couplers, said N radiating elements providing one of linear and circular polarization;

N amplifiers having outputs coupled to said N RF couplers;

a second multilevel stripline package comprising N, M-way power dividers each of which has an output coupled to one of said N amplifiers and M inputs, wherein M and N are integers, individual ones of said M inputs being coupled to an output of M, N-way power dividers having N outputs and one input, wherein said second multilevel stripline package is comprised of a plurality of stacked circuit boards in which individual ones of pairs of circuit boards are disposed back-to-back and are electrically coupled together by feedthroughs, and wherein adjacent circuit boards of adjacent pairs of circuit boards are electrically coupled together by RF coupling means comprised of quarter-wavelength overlapping lines that are separated one from another by a film.

* * * * *